US005592993A

United States Patent [19]

Parish, II et al.

[11] Patent Number: 5,592,993

[45] Date of Patent: Jan. 14, 1997

[54] DIRECTIONAL AUGER ATTACHMENT

[75] Inventors: Robert O. Parish, II, Cleveland; Cleve C. Reber, Pasadena, both of Tex.

[73] Assignee: TTI Trenchless Technologies, Inc., Conroe, Tex.

[21] Appl. No.: 431,106

[22] Filed: Apr. 28, 1995

[51] Int. Cl.[6] ..... E21B 3/02; E21B 7/02

[52] U.S. Cl. ..... 175/162; 173/148; 173/159; 175/203

[58] Field of Search ..... 175/162, 203; 173/28, 148, 159; 37/403

[56] References Cited

U.S. PATENT DOCUMENTS 4,020,909 5/1977 Airavdo ..... 173/28 X
5,033,554 7/1991 Younes ..... 175/203 X

FOREIGN PATENT DOCUMENTS 941280 11/1963 United Kingdom ..... 175/162

OTHER PUBLICATIONS

Brochure–Bay Shore Systems, Inc., Benicia, Calf. 2 pages (undated).

Brochure–McMillen dir of States Engineering Corporation, Fort Wayne, Indiana (undated) 2 pages.

*Primary Examiner*—David J. Bagnell
*Attorney, Agent, or Firm*—Mary J. Gaskin

[57] ABSTRACT

The present invention is directed to an auger attachment which is mounted on the stick of a backhoe which provides directional capabilities to the auger. More specifically, the auger attachment includes an outer body, an inner telescoping body and a piston within the inner body which provides all the lift to the auger.

2 Claims, 6 Drawing Sheets

DIRECTIONAL AUGER ATTACHMENT

FIELD OF THE INVENTION

The present invention is directed to an auger attachment mounted on the stick of a backhoe to provide the flexibility to drill a vertical hole or a directionally drilled hole formed by the auger. More specifically, the invention is directed to an auger attachment having a 24" auger to produce a hole to a polyolefin utility main line so that a down hole fusing apparatus may be introduced into the hole to fuse a service line or t-section to the utility line.

BACKGROUND OF THE INVENTION

The conventional mountings to connect an auger with a backhoe provide only vertical drilling. The backhoe boom usually provides the support for the power source and the lift to remove the auger and dirt from the hole. There are no known auger supports mounted to a backhoe stick where the stick gives the directional capabilities to the auger.

SUMMARY OF THE INVENTION

The present invention is directed to an auger attachment which is mounted on the stick of a backhoe which provides directional capabilities to the auger. More specifically, the auger attachment includes an outer body, an inner telescoping body and a piston within the inner body which provides all the lift to the auger.

DESCRIPTION OF THE PREFERRED EMBODIMENT

Figure 1:
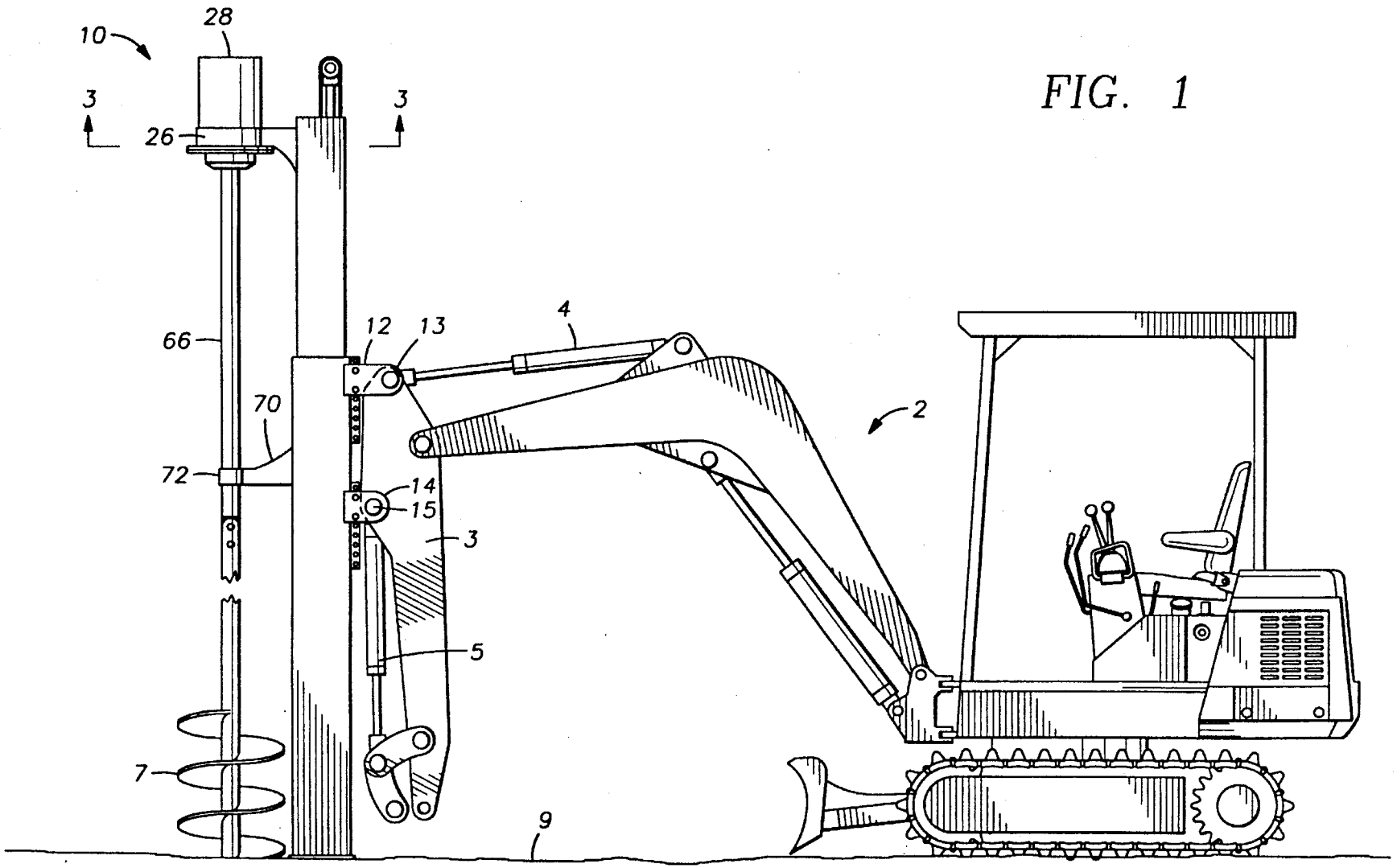
FIG. 1 is an elevation view of a backhoe with the auger attachment of the present invention attached to the stick of the backhoe positioned to drill a vertical hole.

Referring to FIG. 1, the present invention is directed to an auger attachment 10 which is mounted to the stick 3 of a backhoe 2. Two bracket means are preferably used. One bracket means preferably including a plate 12 attached to the stick 3 by inserting a longer pin 13 in an opening in the plate 12 having the same diameter as the pin which attaches one end of the piston 4 to the stick 3. The other bracket means includes a plate 14 and a pin 15, the pin 15 inserted in an opening in plate 14 having the same diameter as the pin which attaches one end of the piston 5 to the stick 3. The other end of plates 12 and 14 may be welded to the auger attachment 10 or preferably will have openings to attach to a plate, which will be described in more detail hereinafter, to adapt to any make and model of backhoe 2. Only two brackets are necessary; however, if desired, an additional support may be used at the lower end of the attachment 10. As illustrated in FIG. 1, the attachment 10 is positioned to drill a vertical hole with the auger 7 and a mound of earth (not shown) surrounds the opening or hole at the surface 9.

Figure 2:
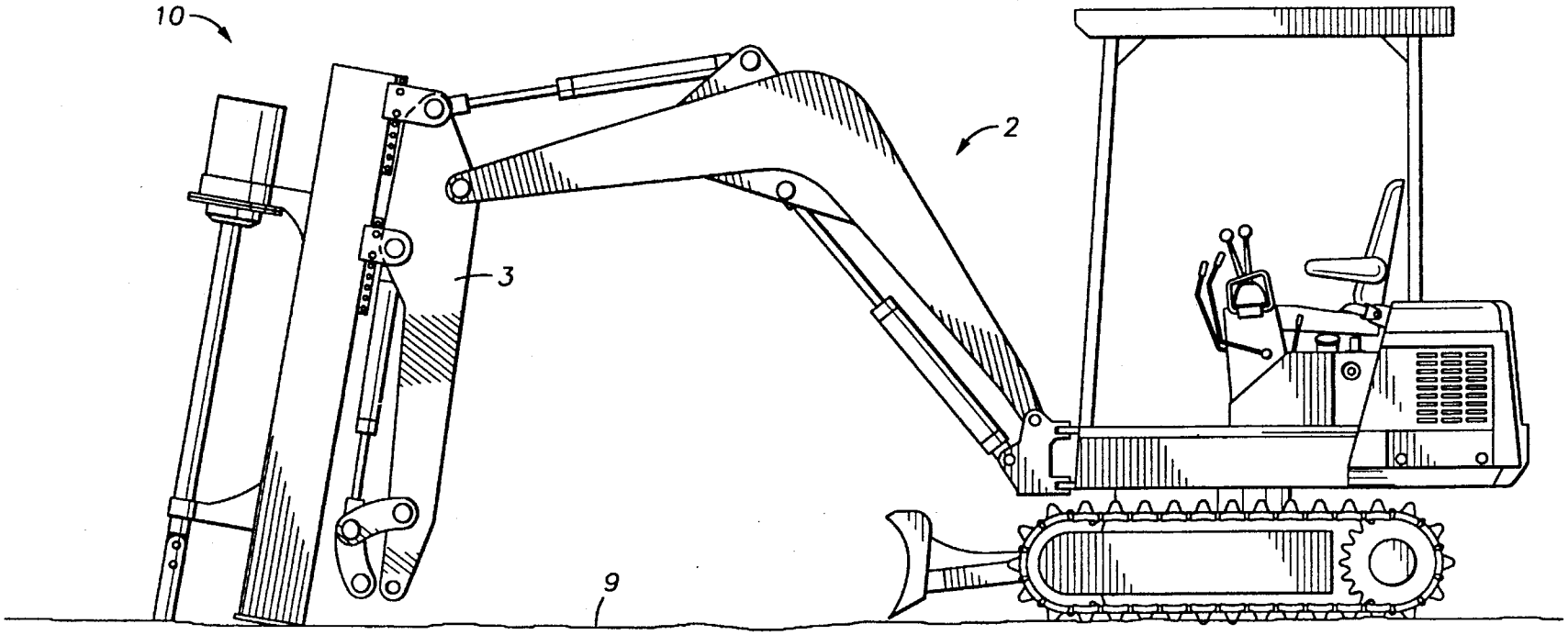
FIG. 2 is an elevation view of a backhoe with the auger attachment of the present invention attached to the stick of the backhoe positioned to drill a directional hole.

The advantage of the auger attachment 10 of the present invention is that not only a vertical hole can be drilled but a directional hole or opening. As shown in FIG. 2, the stick 3 can be moved to a desired angle and the auger attachment 10 will be positioned to drill a directional hole at that desired angle. While the stick 3 is positioned at a directional angle away from the backhoe 2 in FIG. 2, it is understood that the stick 3 may be moved toward the backhoe 2 and the auger attachment positioned at an angle to drill a hole toward the backhoe 2 rather than away. The auger attachment 10 was designed for the purpose of forming an opening from the surface 9 to a polyolefin utility pipe line for fusing a service connection to the polyolefin utility pipe line. The full explanation of the method for making service connections to polyethylene pipe is described in U.S. Pat. No. 5,364,207, which is incorporated herein by reference. The advantage of the directional drilling capabilities of the auger attachment 10 of the present invention is illustrated by making the desired opening from the yard or boulevard of a home to a polyolefin utility pipe line which is running under a street rather than having to drill in the street or by making the desired opening from an open section of a back yard of a home to connect to a polyolefin utility pipe line under a fence or landscaped section of the back yard. The advantage of drilling toward the backhoe 2 is that the backhoe may be in one yard or in an alley and go over a four or five foot fence to drill the opening for a connection in the adjacent yard.

Another advantage of the auger attachment 10 of the present invention is that the operation of the auger 7 uses the auxiliary hydraulic fluid system of the backhoe 2 but does not use the lift of the backhoe to remove the auger 7 from the hole. The hydraulic system used to operate the bucket (shown as removed; however, may be kept on the backhoe 2 and rendered inoperative when operating the auger 7) is used to operate the raising and lowering of the auger 7 when attached to the auger attachment 10 of the present invention. The auger attachment 10 is a fully functioning unit to move the auger up and down and provide the rotation of the auger, as will be described in more detail hereinafter.

Figure 3:
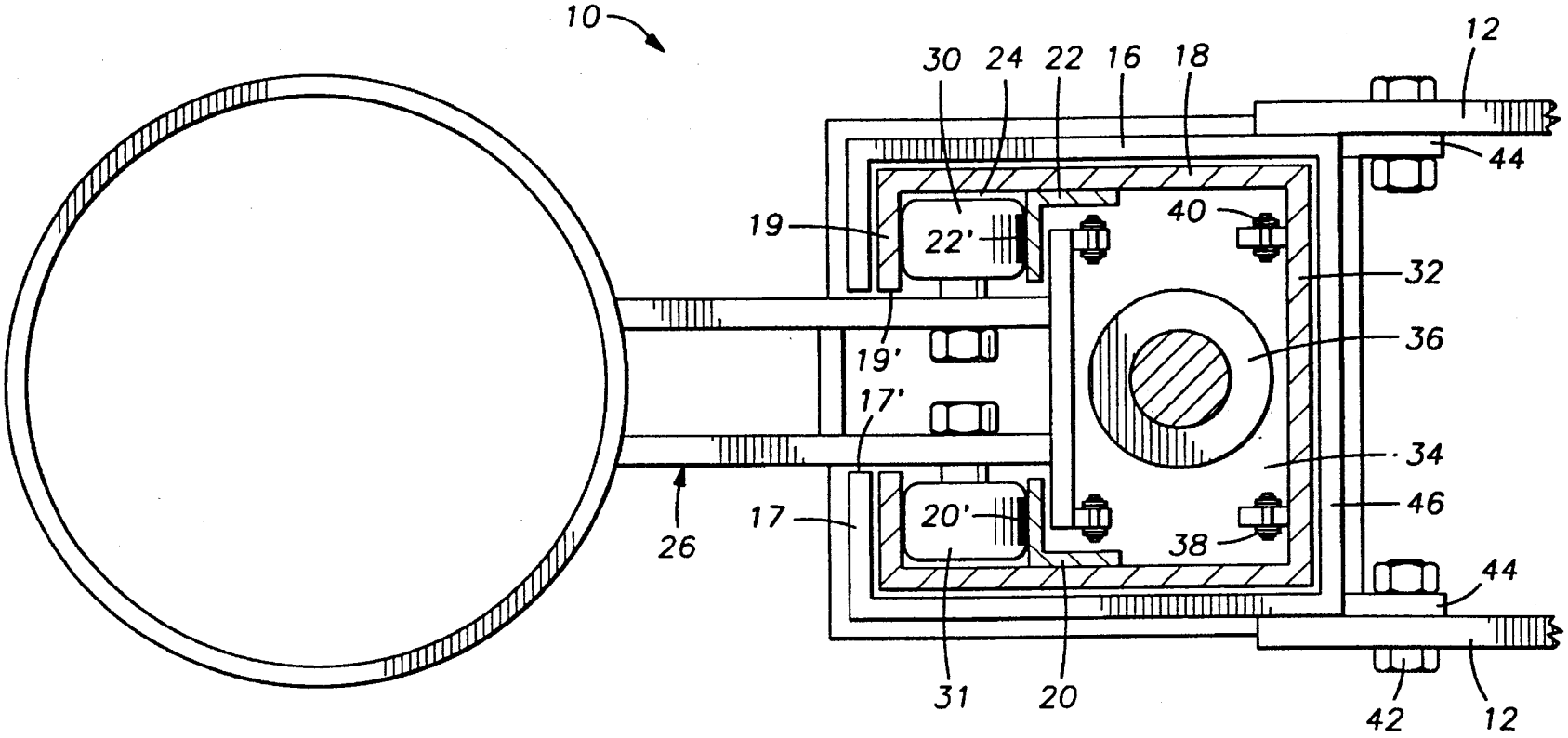
FIG. 3 is a cross-section of the auger attachment of the present invention taken along line 3—3 of FIG. 1.

Referring now to FIG. 3, the auger attachment 10 has an outside body 16, preferably a square channel, and a telescoping inner body 18, preferably a smaller square channel. Both the outside body 16 and the inner body 18 have corresponding front faces 17 and 19, respectively, which have corresponding slots 17' and 19', respectively. Attached to the outside body 16 and extending toward the back of the attachment 10, i.e. opposite the front face 17, are brackets means (plate or bracket 12 shown in FIG. 3) which attach the auger attachment 10 to a backhoe. Inside the inner body 18 is attached, preferably by welding, two L-channels 20 and 22 which have one face 20' and 22', respectively, extending into the inner body 18 parallel to the front face 19 of inner body 18. Face 19 and the faces 20' and 22' form a travel channel 24 for a travel block 26 which carries the motor 28 (see FIG. 1). Travel block 26 has four rollers, two rollers 30 one side and two rollers 31 on the other side of block 26. As can be seen in FIG. 3, the rollers 30 and 31 roll within the travel channel 24 and bear against faces 19, 20' and 22'.

Figure 4:
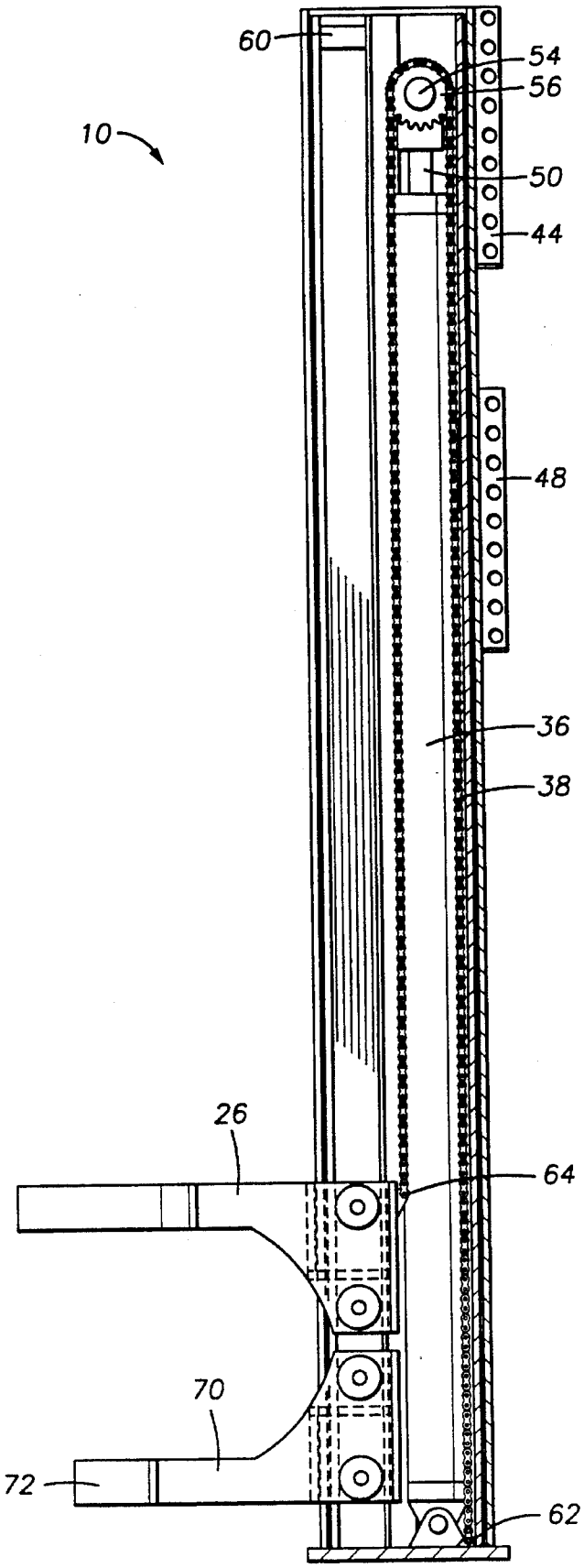
FIG. 4 is a vertical cross-section of the auger attachment of the present invention.

The L-channels 20 and 22 and the back face 32 form a piston chamber 34. In the piston chamber 34 is a piston 36 which extends nearly the entire height of the inner body 18, further detailed description will be made hereinafter. Besides the piston 36, two chains 38 and 40 are also in the piston chamber 34. The operation of the auger attachment 10 will be made with reference to FIG. 4. The position of the travel block 26 of attachment 10 is shown in its lowermost position and the position when the piston rod of piston 36 is in the fully retracted position. This is also the position of the travel block 26 and piston 36 when the auger attachment 10 of the present invention is attached to the stick 4 of a backhoe 2. The attachment 10 is preferably attached to the stick 3 with one set of plates forming the bracket 12, one plate of each set on either side of the stick 3 and having an opening through which a pin is driven and another opening through which a bolt 42 may be place into a welded plate 44 extending from the back face 46 of the outer body 16. A second bracket 14 is similar in construction as bracket 12; however, the set of plates of this bracket are attached to welded plate 48. The plates 44 and 48 have a plurality of openings to fit the various models of backhoes 2. After connection of the auger attachment 10 to the stick 4 of the backhoe 2 by brackets 12 and 14, the hydraulics are connected to the piston 36 and the motor 28. The hydraulic lines normally used to operate the bucket are modified with a two way valve to operate either the bucket or the piston 36 of the auger attachment 10 and the auxiliary lines already available on the backhoe 2 are attached to the motor 28. The description of the connection of the hydraulic fluid lines will be set forth hereinafter with reference to FIG. 9.

Figure 5:
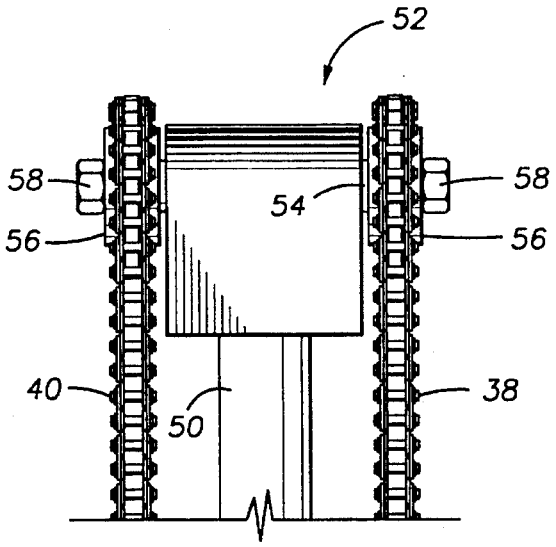
FIG. 5 is a front view of the chain sprocket idler of the present invention.

The travel block 26 is moved upward by actuating the piston 36 and extending the piston rod 50. At the top of rod 50 is a chain sprocket idler 52 having an axle 54 carrying two sprockets 56, one on each side of the rod 50 (see front view in FIG. 5). The sprockets 56 are held on the axle 54 by a nut 58; however, a cap and set screw, a cotter pin or any of a number of simple devices may be used to keep the sprockets on the axle 54. Each of the chains 38 and 40 is attached at one end 62 to the base of outside body 16, passes over a sprocket 56 and is attached to the travel block 26 at the other end 64. As rod 50 is extended, the travel block 26 is raised (at a ratio of 2:1, i.e. the travel block is raised two feet for every foot of extension of the piston rod). An extender rod 66 is connected to the motor 28 and then the auger rod 68 is attached to rod 66.

To begin drilling, the piston 50 is raised so that the auger is touching the surface 9 at the desired point and angle. In most instances when the surface is dirt, the auger will make the first cut into the ground; however, it may be desired to use a shovel to cut through grass or gravel to start the auger in the desired direction. The motor 28 is actuated to rotate the auger in the direction to drill into the ground. After drilling into the ground (in about two foot bites) which lowers the piston rod 50, the rotation of the motor 28 is reversed, the piston 50 raised to raise the travel block 26 carrying the auger out of the ground and the dirt in that bite spun off the auger 7. This operation is repeated until the auger reaches the polyolefin main utility line. It is noted in FIG. 4 below the travel block 26 is a steady rest or stabilizer 70 which has a collar 72 which surrounds the extension rod 66. Stabilizer 70 maintains the extender rod 66 straight and prevents wobbling of the auger. There is a rod (not shown) attached to the stabilizer 70 which extends through the travel block 26 having a plate or large nut at its upper end which when the travel block 26 is raised catches on the travel block 26 and raises the stabilizer 70. The vertical height (as shown) of the outside body 16, the telescoping inner body 18 and the piston 36 will determine the depth to which the auger can dig or drill.

Figure 6:
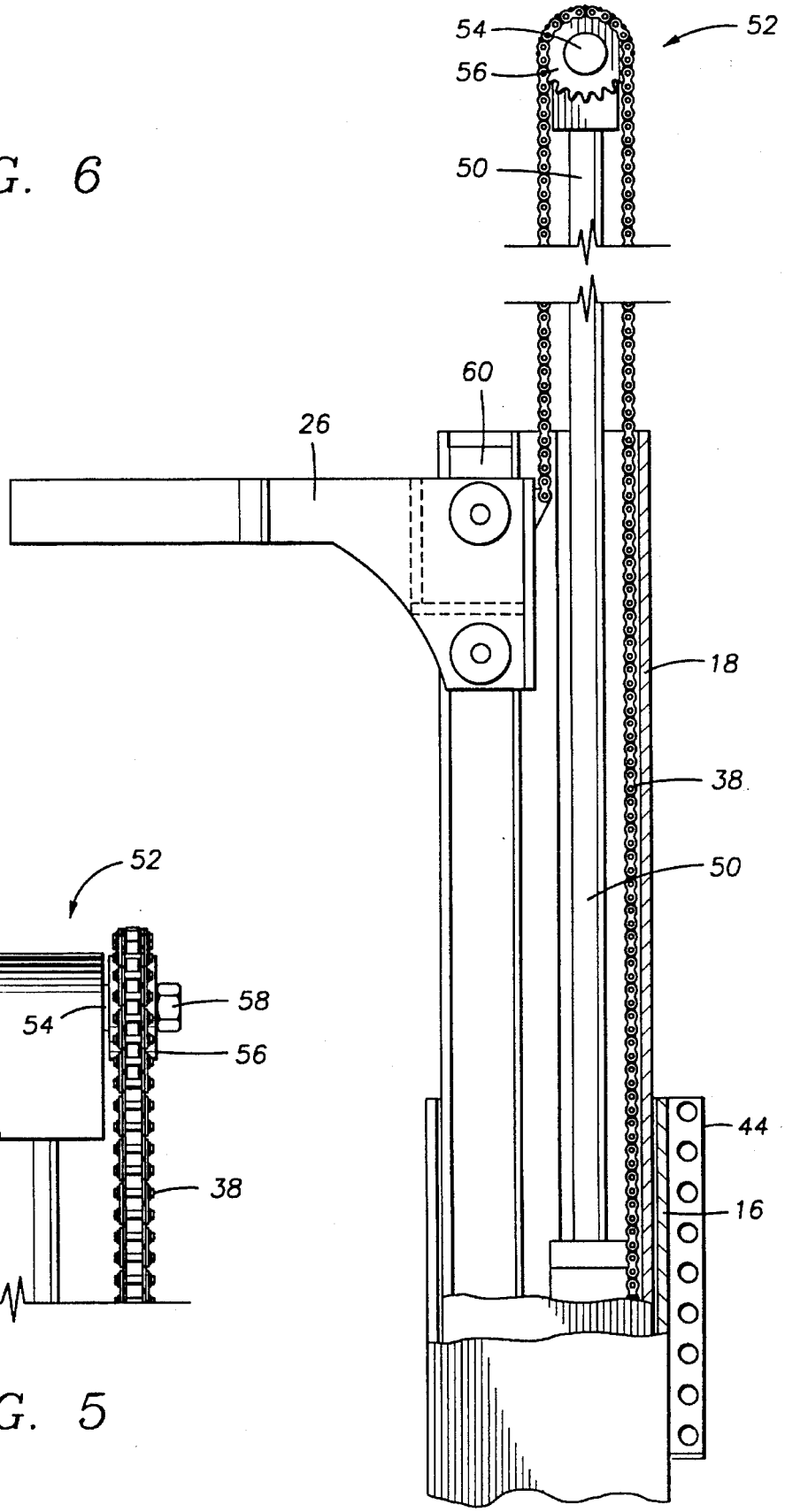
FIG. 6 is a partial cross-section of the auger attachment of the present invention in an extended telescopic position.

Referring to FIG. 6, the auger attachment 10 is shown in the telescoping position. As the piston rod 50 is raised to a position where the travel block 26 is raised almost to the top of the inner body 18, the top rollers 30 and 31 of the travel block 28 are stopped by a stop block 60 in the travel channel 24. Any further extension of piston rod 50 then raises the inner body 18 out of the outside body 16 to raise the travel block 28 higher from the surface 9.

Figure 7:
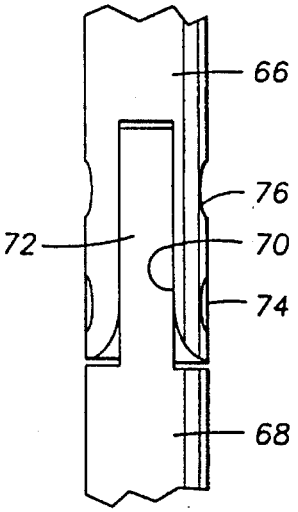
FIG. 7 and FIG. 8 are a front and side view of the connection for the auger rod to the motor of the auger attachment of the present invention.
Figure 8:
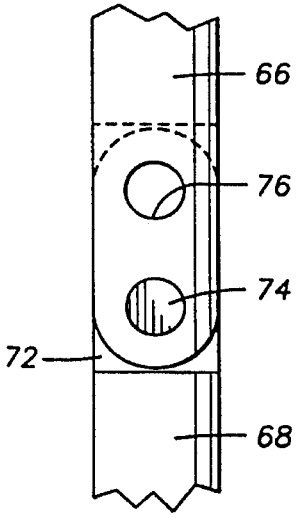

Referring to FIGS. 7 and 8, the ends of the extender rod 66 and the end of the auger rod 68 have a preferred construction as shown in these figures. One rod has an end with a groove 70 and the other rod has a tounge 72. The two rods are connected together with two pins, one pin 74 in the transverse opening of the end having the groove 70 and the end having the tongue 72. The second opening 76, when the transverse opening in both the end having the groove 70 and the end having the tongue 72 are aligned, does not have the pin in the opening 76 and therefore, one rod can rotate relative to the other. This feature is helpful when assembling or disassembling the auger 7 to the motor 28 or when at least one extender rod 66 is employed.

Figure 9:
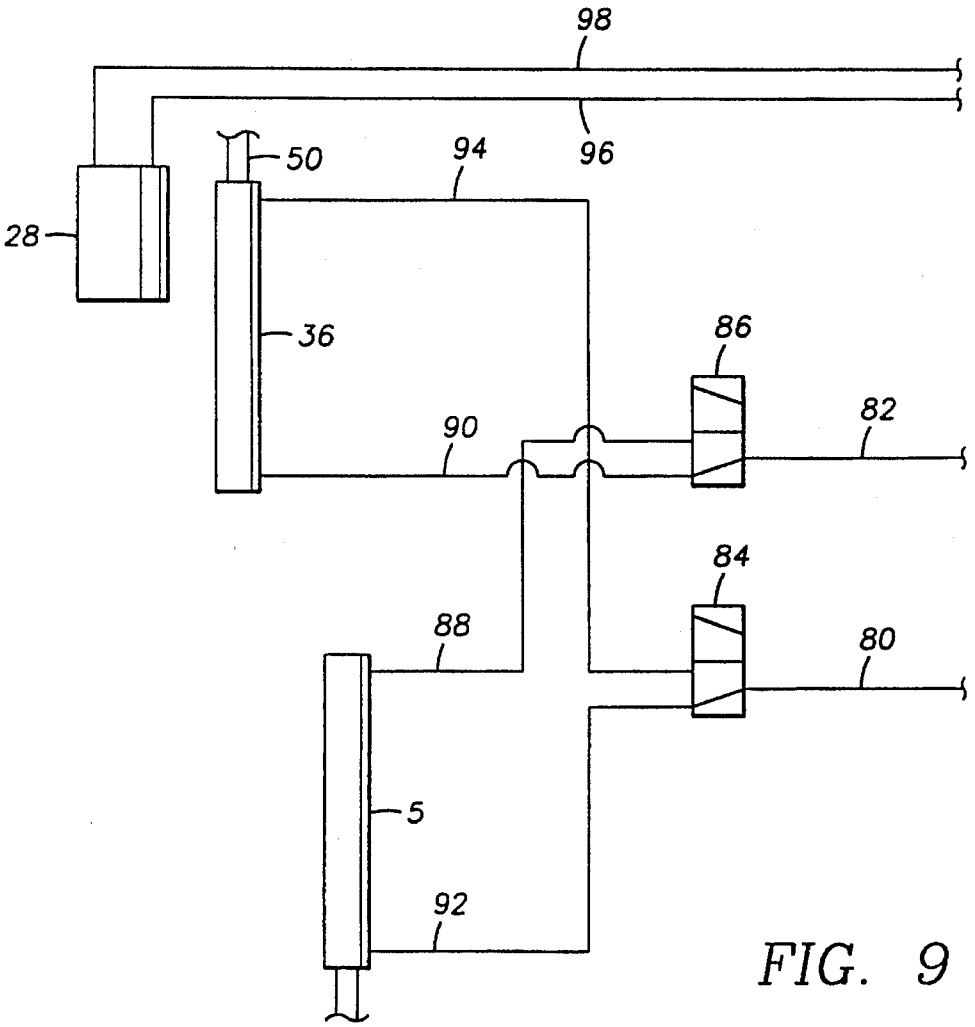
FIG. 9 is a view of the hydraulic connection showing a two way valve in the hydraulic lines of the backhoe.

As was mentioned hereinabove, the hydraulic system of the backhoe 2 is utilized to power the motor 28 for the auger 7 and the piston 36 which raises and lowers the travel block 26 on which the motor 28 rests. FIG. 9 is a schematic diagram of the hydraulic system employed with the auger attachment 10 of the present invention. The hydraulic lines 80 and 82 which normally operate the piston 5 or move the bucket of backhoe 2 are uncoupled and two-way valves 84 and 86 placed in the lines. Line 88 goes to the top of piston 5 and line 90 goes to the top of piston 36 and when fluid is forced through either line 88 or 90, the piston rods of the pistons are extended. Line 92 and line 94 are attached to valve 84 which retracts the pistons. When valves 84 and 86 are turned to operate piston 36 in the auger attachment 10 of the present invention, fluid forced through the line 90 will extend the piston rod 50 of piston 36. Auxiliary equipment lines which are standard on most backhoes 2 are connected to motor 28. In this configuration, the bucket of the backhoe 2 or the auger attachment 10 can be made operational without removing the auger attachment 10 from the stick 3 by simply turning the two-way valves 84 and 86.

There are simple changes which may be made to accommodate the many sizes and models of backhoes. Likewise the dimensions of the auger attachment 10 can accommodate the depth the auger 7 can dig or drill.

We claim:

1. An auger attachment which is mounted on the stick of a backhoe which comprises;

a square-channel outside body having a slot in its front face;

bracket means extending from said outside body for attaching said outside body to said stick of a backhoe:

a telescoping, square-channel inner body having a slot in its front face which is aligned with the slot in the front face of said outside body: said inner body moving within said outside body, said inner body having means to provide a travel channel and a piston chamber;

a travel block extending through both of said slots and moving within said travel channel:

a stabilizer disposed below said travel block, said stabilizer extending through both of said slots in said inner and outside body and moving within said travel channel;

a piston in said piston chamber; said piston having piston rod;

hydraulic fittings for actuating said piston;

on an end of said piston rod, means for carrying two spaced-apart chain sprockets:

two chains within said piston chamber, each connected at one end to said travel block, extended over one of said sprockets, and connected at its other end to a lower end of said outside body;

a centrifugal motor mounted on said travel block, said motor capable of turning an auger; and hydraulic fittings for actuating said motor and rotating said auger in both directions and for actuating said piston to raise and lower said travel block.

2. A backhoe which provides directional drilling for an auger having a boom and boom piston, a stick and stick piston and a bucket and bucket piston, a hydraulic system for said backhoe pistons and an auxiliary equipment hydraulic system which comprises:

an auger attachment connected to said stick which comprises:

a square-channel outside body having a slot in its front face;

bracket means extending from said outside body for attaching said outside body to said stick of a backhoe:

a telescoping, square-channel inner body having a slot in its front face which is aligned with the slot in the front face of said outside body, said inner body moving within said outside body; said inner body having means to provide a travel channel and a piston chamber;

a travel block extending through both of said slots and moving within said travel channel;

a stabilizer disposed below said travel block, said stabilizer extending through both of said slots in said inner and outside body and moving within said travel channel of said auger attachment:

a piston in said piston chamber, said piston having a piston rod:

hydraulic fittings for actuating said piston;

on an end of said piston rod, means for carrying two spaced-apart chain sprockets:

two chains within said piston chamber, each connected at one end to said travel block, extended over one of said sprockets, and connected at its other end to a lower end of said outside body;

a centrifugal motor mounted on said travel block, said motor capable of turning an auger; and hydraulic fittings for actuating said motor and rotating said auger in both directions and for actuating said piston to raise and lower said travel block, a two-way valve placed in the hydraulic lines of said bucket piston of said backhoe to connect the hydraulic system of said backhoe to actuate either said piston of said auger attachment or said bucket of said backhoe: and hydraulic lines connected to the auxiliary equipment hydraulic system of said backhoe and to the hydraulic fittings of said motor of said auger attachment.

* * * * *